US005434339A

United States Patent [19]

La Motte et al.

[11] Patent Number: 5,434,339

[45] Date of Patent: Jul. 18, 1995

[54] APPLYING A FLUID ABSORPTION MAT TO A FLOOR

[76] Inventors: Dennis K. La Motte, 25261 Bunting Cir., Land O Lakes, Fla. 34639; Anthony J. Senzamici, Jr., 620 Travis Cir., Lakeland, Fla. 33813

[21] Appl. No.: 361,169

[22] Filed: Dec. 21, 1994

Related U.S. Application Data

[63] Continuation of Ser. No. 33,683, Mar. 16, 1993, abandoned.

[51] Int. Cl.[6] ..... A62D 3/00

[52] U.S. Cl. ..... 588/258; 428/74; 588/249

[58] Field of Search ..... 588/259, 249, 258; 428/74, 68; 604/368, 378

[56] References Cited

U.S. PATENT DOCUMENTS

| | | | |
|---|---|---|---|
| 4,295,987 | 10/1981 | Parks | 252/194 |
| 4,693,713 | 9/1987 | Chmelir et al. | 604/368 |
| 4,865,886 | 9/1989 | Itoh et al. | 427/342 |
| 5,066,527 | 11/1991 | Newell | 428/74 X |
| 5,079,792 | 1/1992 | D'Haen | 428/74 X |
| 5,135,792 | 8/1992 | Hogan | 428/74 |
| 5,150,707 | 9/1992 | Anderson | 604/368 X |
| 5,175,046 | 12/1992 | Nguyen | 428/74 X |
| 5,246,429 | 9/1993 | Poccia et al. | 604/368 |
| 5,252,332 | 10/1993 | Goldstein | 428/74 X |
| 5,252,374 | 10/1993 | Larsonneur | 604/368 X |

*Primary Examiner*—Dennis L. Taylor
*Attorney, Agent, or Firm*—Herbert W. Larson

[57] ABSTRACT

A fluid absorption mat is applied to the floor of a surgery room during medical procedures. Patient body fluids drip onto the mat while medical personnel stand on the mat. The fluids are absorbed by the mat through an upper and lower non-woven non-cellulose fibrous material and into a copolymer intermediate layer. The upper and lower layer dry while the intermediate layer retains any fluids absorbed by the mat. The mat is then disposed into a waste container. Medical personnel are thereby exposed to minimal patient body fluids and the clean up of the surgery room is more efficient and cleaner.

4 Claims, 2 Drawing Sheets

APPLYING A FLUID ABSORPTION MAT TO A FLOOR

This application is a continuation of application Ser. No. 08/033,683, filed Mar. 16, 1993, now abandoned.

BACKGROUND OF THE INVENTION

1. Field of the Invention

This invention relates to a method of absorbing liquids in a floor mat. More particularly, it relates to a method of applying a mat to a floor of a hospital operating room or ambulatory surgery center for use in absorbing body fluids spilling onto the floor during a medical procedure and retaining such fluids for easy disposal.

2. Description of Prior Art

Liquid absorptive polymer materials are well known in the prior art as seen in U.S. Pat. Nos. 4,295,987 and 4,865,886. In addition, it is known to incorporate these polymers between paper or diaper cloth to make absorptive materials. The aforementioned U.S. Pat. No. 4,865,886 describes polymerizing acrylic acid monomers on prefabricated fibrous substrate to form a composite of the polymer derived from the monomer and said fibrous substrate. Crosslinking agents are then reacted with the polymer to form a liquid absorptive polymer.

The prior art composite materials are excellent vehicles for absorbing liquids, but are not designed to retain liquids when pressure, such as the weight of a person, is exerted on the absorbent materials.

A method for employing a self contained floor mat is needed which will absorb and retain body fluids in the floor mat even when there is the pressure of a standing person and prevent leakage of the body fluids during the disposal process.

SUMMARY OF THE INVENTION

We have discovered a method of employing a floor mat that will absorb and retain patient body fluids during a medical procedure thereby protecting operating room personnel from extensive exposure to the patient body fluids and assisting in a cleaner and more efficient disposal process of these fluids.

Our method employs a three layered mat placed on an operating room floor. Art upper and lower outer layer of the mat contains an absorbent non-woven fiber and a middle layer contains a liquid absorbent and retaining copolymer mechanically interlocked between the two fibrous outer layers. The edges of the mat are held together by a seam to prevent outward migration of the copolymer and to assist in the retention of liquids. Any body fluids or irrigation fluids dripping or spilling onto the mat are absorbed into the copolymer and are retained therein. The mat is disposed of without any leakage or migration of fluids from the mat at a time after the non-woven fibrous outer layers have dried.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
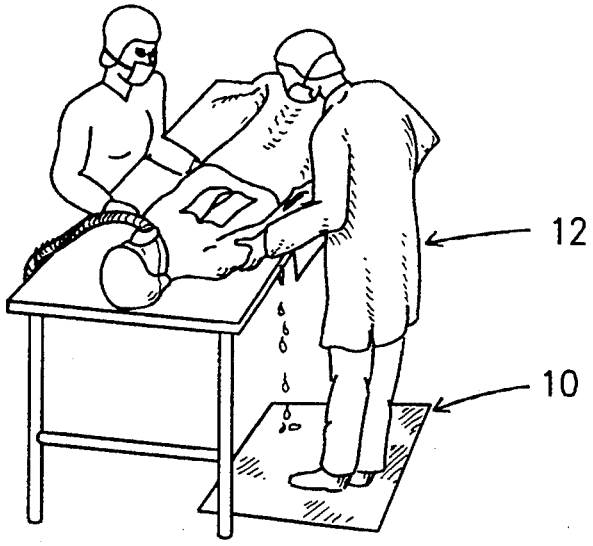
FIG. 1 depicts the method of the invention.

Throughout the following detailed description, the same reference numerals refer to the same elements in all figures.

Our method of absorbing and retaining body fluids or irrigation fluids during a medical procedure is shown in FIG. 1. A mat 10 is placed on a hospital room operating floor or ambulatory surgery center floor 12 in an area where patient body fluids drip and hospital personnel stand during a medical procedure as shown in FIG. 1. The mat 10 has three layers, an upper layer 14, a bottom layer 16, and an intermediate layer 18, as shown in FIG. 2.

The upper layer 14 and the bottom layer 16 are made of a fluid absorbing, non-woven, non-cellulose, fibrous material such as felt. The intermediate layer 18 is made of a liquid absorbent and retaining cross-linked polyacrylic acid/polyalcohol grafted copolymer mechanically interlocked between the two fibrous upper and lower layers 14 and 16 respectively. The copolymers of U.S. Pat. Nos. 4,295,987 and 4,865,886 are useful for the intermediate layer and are herein incorporated by reference. The upper and lower layers 14 and 16 enclose the intermediate layer 18 and are held together by a seam 20. The seam 20 is stitched with a heavy duty nylon sewing thread. The intermediate layer 18 can be injected between the upper layer 14 and the bottom layer 16 or can be laid over the bottom layer 16 and then covered with the upper layer 14.

Figure 2:
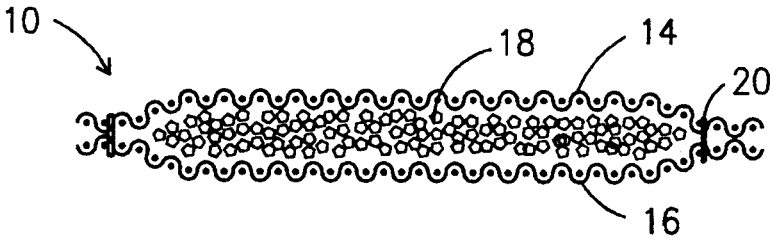
FIG. 2 is a sectional elevational view of the mat depicting the polymer crystals of the intermediate layer in a dry state.
Figure 3:
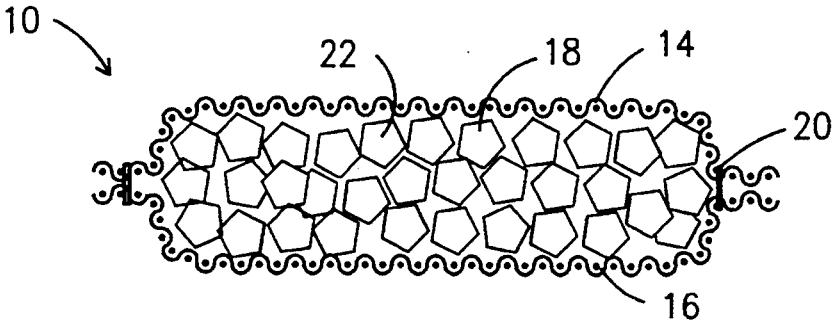
FIG. 3 is a sectional elevational view of the mat after having absorbed and retained a fluid.
Figure 7:
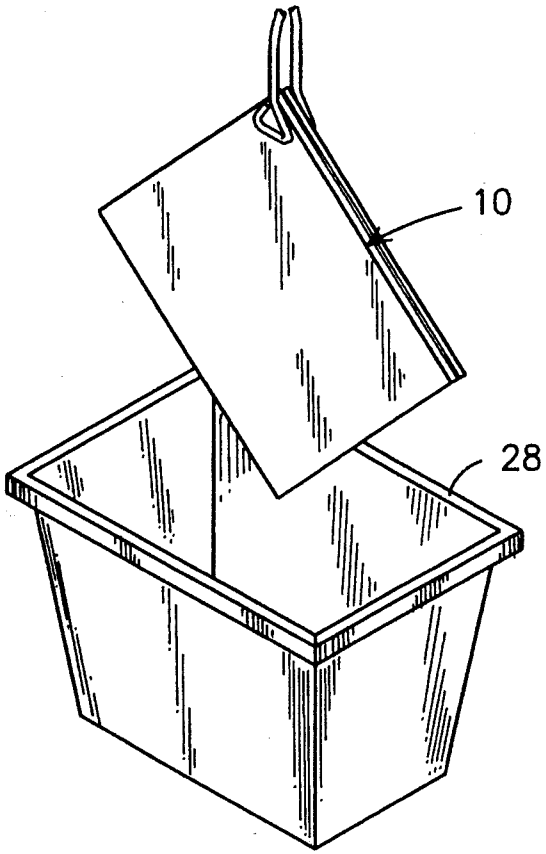
FIG. 7 depicts a method step of the invention wherein the mat is being disposed of with no fluids migrating from it.

As seen in FIG. 2 the mat 10 is in its dry state when no fluids have dripped or spilled onto the mat 10. In FIG. 3 the mat 10 is in its fluid absorbed and retained state. As fluids spill onto the mat 10 as shown in FIG. 1, the upper layer 14 and the bottom layer 16 allow the fluids to soak through its fibrous material. The fluid is then absorbed into the copolymer intermediate layer 18. Crystals 22 of the copolymer intermediate layer 18 expand thereby absorbing the fluid as shown in FIG. 3. The seam 20 assists in retaining any absorbed fluid in the mat 10. The upper layer 14 and the bottom layer 16 dry at a time after no further fluids have made contact with the mat 10. Thereafter, the mat 10 can be disposed of into a container 28 or any other disposal bag with no fluids migrating or dripping from the mat 10 as shown in FIG. 7. The mat 10 can retain up to three hundred times its own weight in body fluids.

Figure 4:
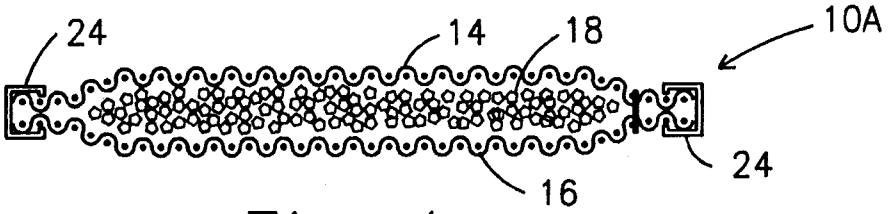
FIG. 4 is a sectional elevational view of a first alternate version of the mat with a nylon edge binding and depicting the polymer crystals of the intermediate layer in a dry state
Figure 5:
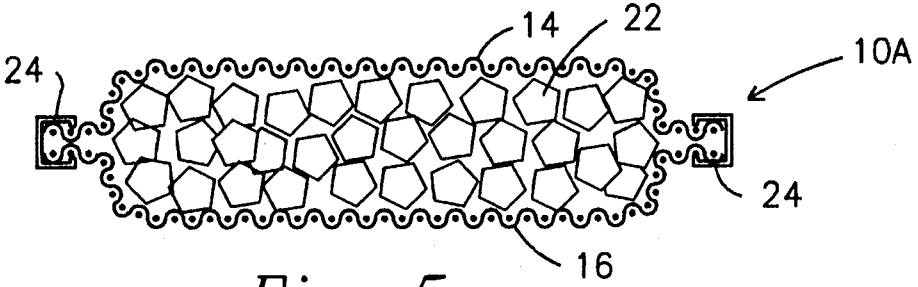
FIG. 5 is a sectional elevational view of the first alternate version of the mat with a nylon edge binding and having absorbed and retained a fluid.

An alternate mat 10A shown in FIGS. 4 and 5 is the same as the mat 10 shown in FIGS. 2 and 3 except for an edge guard binding 24 in place of the seam 20. This edge guard binding 24 is made of nylon and can be stitched around the edge of the upper layer 14 and lower layer 16 to hold the layers 14 and 16 in place. The edge guard binding 24 retains the copolymer intermediate layer 18 in place and thereby facilitates the retention of absorbed fluids.

Figure 6:
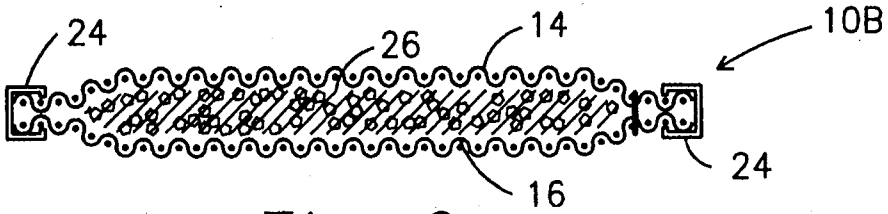
FIG. 6 is a sectional elevational view of a second alternate version of the mat depicting the polymer crystals of the intermediate layer embedded in paper and in a dry state.

Another alternate mat 10B shown in FIG. 6 is the same as mat 10A shown in FIGS. 4 and 5 except the copolymer intermediate layer is embedded in a paper layer 26. Other absorbent materials can be substituted for the paper embedded within the copolymer.

Equivalent elements can be substituted for the elements of the mat to perform the method of this invention in the same way.

Having thus described the invention what is claimed and desired to be secured by Letters Patent is:

1. A method of protecting surgery room personnel from exposure to patient body fluids or irrigation fluids comprising applying to a surgery room floor in an area into which patient body fluids can drip, and over which surgery room personnel must stand, a floor mat having at least three layers on which surgery room personnel stand, an upper layer and bottom layer of the floor mat made from a fluid absorbing non-woven, non-cellulose, fibrous material and an intermediate layer containing a fluid absorbent and retaining cross-linked polyacrylic acid/polyalcohol grafted copolymer mechanically interlocked between the two fibrous layers, an edge of the two fibrous layers joined together on all sides to hold together permanently the edges of the two fibrous layers to prevent outward migration of the copolymer and retaining the absorbed body fluids in the mat, drying upper and bottom layers of the floor mat, and disposing of the floor mat after a medical procedure without the outward migration of body fluids from the floor mat.

2. A method of protecting surgery room personnel from exposure to patient body fluids or irrigation fluids according to claim 1 wherein the copolymer is impregnated into a paper base to form the intermediate layer.

3. A method of protecting surgery room personnel from exposure to patient body fluids or irrigation fluids according to claim 1 wherein the edge of the two fibrous layers is enclosed by a binding.

4. A method of protecting operating room personnel from exposure to patient body fluids or irrigation fluids according to claim 1 wherein the edge of the two fibrous layers is joined together by a stitching.

* * * * *